US009375611B2

(12) United States Patent
Sajima et al.

(10) Patent No.: US 9,375,611 B2
(45) Date of Patent: Jun. 28, 2016

(54) GOLF BALL AND METHOD FOR PRODUCING THE SAME

(71) Applicant: DUNLOP SPORTS CO. LTD., Kobe-shi, Hyogo (JP)

(72) Inventors: Takahiro Sajima, Kobe (JP); Kohei Mimura, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days.

(21) Appl. No.: 14/583,313

(22) Filed: Dec. 26, 2014

(65) Prior Publication Data

US 2015/0182805 A1 Jul. 2, 2015

(30) Foreign Application Priority Data

Dec. 27, 2013 (JP) ..... 2013-273039
Jan. 17, 2014 (JP) ..... 2014-007119

(51) Int. Cl.
*A63B 37/14* (2006.01)
*A63B 37/00* (2006.01)
*A63B 45/00* (2006.01)
(Continued)

(52) U.S. Cl.
CPC ..... *A63B 37/0029* (2013.01); *A63B 37/0004* (2013.01); *A63B 37/0022* (2013.01); *A63B 37/0033* (2013.01); *A63B 37/14* (2013.01); *A63B 45/00* (2013.01); *A63B 45/02* (2013.01); *B05D 5/02* (2013.01); *A63B 37/0074* (2013.01); *A63B 37/0075* (2013.01); *B05D 2350/60* (2013.01)

(58) Field of Classification Search
CPC . A63B 37/0022; A63B 37/14; A63B 37/0004
See application file for complete search history.

(56) References Cited

U.S. PATENT DOCUMENTS 4,438,924 A * 3/1984 Carr ..... A63B 37/14 473/613
4,763,900 A * 8/1988 Carr ..... A63B 59/50 473/457
4,787,638 A * 11/1988 Kobayashi ..... A63B 37/0004 473/383

(Continued)

FOREIGN PATENT DOCUMENTS

EP 2 671 619 A1 12/2013
JP 2002-369896 * 12/2002 ..... A63B 37/00

(Continued)

OTHER PUBLICATIONS

Partial European Search Report issued Mar. 31, 2015, in European Patent Application No. 14200444.9.

(Continued)

*Primary Examiner* — John E Simms, Jr.
(74) *Attorney, Agent, or Firm* — Birch, Stewart, Kolasch & Birch, LLP

(57) ABSTRACT

A golf ball that enhances flight performance is provided. A golf ball according to the present invention includes a spherical core, at least one cover member that covers the core, and a coating layer that covers the cover member configuring the outermost layer. A plurality of dimples are formed in the cover member configuring the outermost layer. The thickness of the coating layer is 5.0 μm or more. Roughness is formed on the surface of the coating layer after coating the cover member configuring the outermost layer. The maximum height Rz and the arithmetic average roughness Ra of the surface of the coating layer satisfy the relationship Rz≥Ra× 6.0.

12 Claims, 2 Drawing Sheets

(51) Int. Cl.
*B05D 5/02* (2006.01)
*A63B 45/02* (2006.01)

(56) References Cited

U.S. PATENT DOCUMENTS 6,193,617 B1 * 2/2001 Mertens ..... A63B 37/0003 473/351
8,932,149 B2 * 1/2015 Oldknow ..... A63B 53/0466 473/327
2011/0106500 A1 * 5/2011 Sato ..... A63B 37/0004 703/1
2012/0184397 A1 * 7/2012 Fitchett ..... A63B 37/0022 473/383
2012/0328782 A1 * 12/2012 Fitchett ..... A63B 37/0022 427/289
2012/0329367 A1 12/2012 Fitchett et al.
2012/0329577 A1 * 12/2012 Anderl ..... A63B 37/0022 473/378
2013/0168896 A1 * 7/2013 Tutmark ..... A63B 45/00 264/219
2013/0260916 A1 * 10/2013 Tomita ..... A63B 37/0003 473/372
2013/0331205 A1 * 12/2013 Tarao ..... C08G 18/4854 473/378

FOREIGN PATENT DOCUMENTS

JP 2004-147836 * 5/2004 ..... A63B 37/00
JP 2066-75210 A 3/2006
KG 10-234885 A 9/1998

OTHER PUBLICATIONS

Extended European Search Report issued Feb. 1, 2016, in European Patent Application No. 14200444.9.

* cited by examiner

GOLF BALL AND METHOD FOR PRODUCING THE SAME

TECHNICAL FIELD

The present invention relates to a golf ball and a method for producing the same.

BACKGROUND ART

A golf ball has a large number of dimples on its surface. The dimples disturb airflow around the golf ball during flight and cause turbulent separation. This phenomenon is referred to as "turbulence". Turbulence causes a separation point of air from the golf ball to shift rearward, and thus drag is reduced. Moreover, turbulence promotes the displacement between an upper separation point and a lower separation point due to backspin, and thus lift acting on the golf ball is enhanced. Accordingly, good dimples disturb airflow better, and thus largely extend the flight-distance.

CITATION LIST

Patent Literature

Patent Literature 1: JP H10-234885A

SUMMARY OF INVENTION

Technical Problem

Incidentally, when a golfer hits a golf ball with a middle iron, for example, a large amount of spin is given to the golf ball. As a result, the golf ball is likely to pop up, and the flight-distance sometimes becomes short. Such a problem is not only associated with middle irons. Conventionally, in order to suppress the pop-up, attempts have been made to improve the dimple specifications when designing the dimples. However, this problem has not been solved yet, and the improvement of aerodynamic performance regardless of the design of dimples has been desired. The present invention was achieved in order to solve the foregoing problems, and it is an object thereof to provide a golf ball that can enhance flight performance.

Solution to Problem

A golf ball according to the present invention includes a spherical core, at least one cover member that covers the core, and a coating layer that covers the cover member configuring an outermost layer, wherein a plurality of dimples are formed in the cover member configuring the outermost layer, the thickness of the coating layer is 5.0 μm or more, roughness is formed on a surface of the coating layer after coating the cover member configuring the outermost layer, and a maximum height Rz and an arithmetic average roughness Ra of the surface of the coating layer satisfy a relationship $Rz \geq Ra \times 6.0$.

In the golf ball, it is possible to set the arithmetic average roughness Ra to be 0.5 μm or more.

In the golf ball, it is possible to set the maximum height Rz to be 4.0 μm or more.

The roughness of the coating layer of the golf ball can be formed by various methods, such as a method in which minute particles are sprayed.

In the golf ball, it is possible to set the average particle diameter of the minute particles to be 50 μm or more.

Alternatively, the roughness of the coating layer of the golf ball can be formed by a metal mold in which roughness is formed on an inner wall surface of a cavity being pressed onto the coating layer obtained by coating the cover member.

A method for producing a golf ball according to the present invention includes a step of forming a spherical core, a step of covering the spherical core with at least one cover member and forming a plurality of dimples in the cover member configuring an outermost layer, a step of covering the cover member configuring the outermost layer with a coating layer, and a step of forming roughness on the coating layer, wherein a maximum height Rz and an arithmetic average roughness Ra of the surface of the coating layer satisfy a relationship $Rz \geq Ra \times 6.0$.

In the method for producing a golf ball, it is possible to set the arithmetic average roughness Ra to be 0.5 μm or more.

In the method for producing a golf ball, it is possible to set the maximum height Rz to be 4.0 μm or more.

The roughness of the coating layer of the golf ball in the method can be formed by various methods, such as a method in which minute particles are sprayed.

In the method for producing a golf ball, it is possible to set the average particle diameter of the minute particles to be 50 μm or more.

Alternatively, the roughness of the coating layer of the golf ball in the method can be formed by a metal mold in which roughness is formed on an inner wall surface of a cavity being pressed onto the coating layer obtained by coating the cover member.

Advantageous Effects of Invention

With the golf ball according to the present invention, it is possible to enhance flight performance.

DESCRIPTION OF EMBODIMENTS

1. Golf Ball

Figure 1:
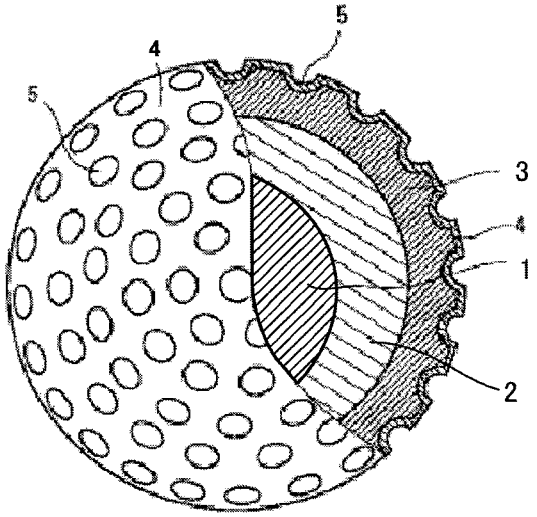
FIG. 1 is a partially cutaway cross-sectional view illustrating an embodiment of a golf ball of the present invention.

Hereinafter, an embodiment of a golf ball according to the present invention will be described with reference to the drawings. FIG. 1 is a partially cutaway cross-sectional view of a golf ball according to this embodiment.

As shown in FIG. 1, the golf ball includes a spherical core 1, an intermediate layer 2 that covers the core 1, a cover 3 that covers the intermediate layer 2, and a coating layer 4 that covers the surface of the cover 3.

The diameter of the golf ball is preferably 40 to 45 mm, and more preferably 42.67 mm or more from the viewpoint of meeting the standards of the United States Golf Association (USGA). From the viewpoint of suppressing air resistance, the diameter is preferably 44 mm or less, and more preferably 42.80 mm or less. Moreover, the mass of the golf ball is preferably 40 g or more and 50 g or less. In particular, from the viewpoint that a large inertia can be provided, the mass is preferably 44 g or more and more preferably 45.00 g or more. From the viewpoint of meeting the standards of the USGA, the mass is preferably 45.93 g or less.

1-1. Core

Next, members configuring the golf ball will be described. The core 1 is formed by crosslinking a rubber composition. Examples of the base rubber for the rubber composition include polybutadiene, polyisoprene, styrene-butadiene copolymer, ethylene-propylene-diene copolymer, and natural rubber. Two or more types of rubber may be used in combination. Moreover, from the viewpoint of restitution performance, polybutadiene is preferable, and high-cis polybutadiene is particularly preferable.

The rubber composition of the core 1 includes a co-crosslinking agent. From the viewpoint of restitution performance, preferable co-crosslinking agents are zinc acrylate, magnesium acrylate, zinc methacrylate, and magnesium methacrylate. It is preferable that the rubber composition includes organic peroxide together with the co-crosslinking agent. Examples of the preferable organic peroxide include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 1 may include additives such as a filler, sulfur, a vulcanization accelerator, a sulfur compound, an antioxidant, a coloring agent, a plasticizer, a dispersant, a carboxylic acid, and a carboxylate. Furthermore, the rubber composition may include synthetic resin powder or crosslinked rubber powder.

The diameter of the core 1 is preferably 30.0 mm or more, and particularly preferably 38.0 mm or more. On the other hand, the diameter of the core 1 is preferably 42.0 mm or less, and particularly preferably 41.5 mm or less. The core 1 may have two or more layers. There is no particular limitation on the shape of the core 1 as long as the core 1 has a spherical shape as a whole, and the core 1 may have ribs on its surface. Moreover, the core 1 may be hollow.

1-2. Intermediate Layer

Next, the intermediate layer 2 will be described. The intermediate layer 2 is made of a resin composition. An ionomer resin is a preferable base polymer for the resin composition. One example of a preferable ionomer resin is a bipolymer of α-olefin and α,β-unsaturated carboxylic acid that has 3 to 8 carbon atoms. Another example of a preferable ionomer resin is a terpolymer of α-olefin, α,β-unsaturated carboxylic acid that has 3 to 8 carbon atoms and α,β-unsaturated carboxylic acid ester that has 2 to 22 carbon atoms. In the bipolymer and the terpolymer, ethylene and propylene are preferable α-olefins, and acrylic acid and methacrylic acid are preferable α,β-unsaturated carboxylic acids. In the bipolymer and the terpolymer, some of the carboxyl groups are neutralized by metal ions. Examples of metal ions for neutralization include a sodium ion, potassium ion, lithium ion, zinc ion, calcium ion, magnesium ion, aluminum ion, and neodymium ion.

The resin composition of the intermediate layer 2 may include another polymer instead of the ionomer resin. Other examples of polymers include polystyrene, polyamide, polyester, polyolefin, and polyurethane. The resin composition may include two or more types of polymers.

The resin composition of the intermediate layer 2 may include a coloring agent such as titanium dioxide, a filler such as barium sulfate, a dispersant, an antioxidant, an ultraviolet absorber, a photostabilizer, a fluorescent agent, a fluorescent brightener, and the like. The resin composition may also include a powder of metal with a high specific gravity, such as tungsten and molybdenum, in order to adjust the specific gravity thereof.

The thickness of the intermediate layer 2 is preferably 0.2 mm or more, and particularly preferably 0.3 mm or more. On the other hand, the thickness of the intermediate layer 2 is preferably 2.5 mm or less, and particularly preferably 2.2 mm or less. The specific gravity of the intermediate layer 2 is preferably 0.90 or more, and particularly preferably 0.95 or more. The specific gravity of the intermediate layer 2 is preferably 1.10 or less, and particularly preferably 1.05 or less. The intermediate layer 2 may have two or more layers. For example, it is possible to arrange a reinforcing layer outside the intermediate layer 2.

1-3. Cover

The cover 3 is made of a resin composition. Polyurethane is a preferable base polymer for the resin composition. The resin composition may include thermoplastic polyurethane or thermosetting polyurethane. From the viewpoint of productivity, thermoplastic polyurethane is preferable. Thermoplastic polyurethane includes a polyurethane component as a hard segment and a polyester component or a polyether component as a soft segment.

Examples of a hardener for the polyurethane component include alicyclic diisocyanate, aromatic diisocyanate, and aliphatic diisocyanate. Alicyclic diisocyanate is particularly preferable. Since alicyclic diisocyanate has no double bonds in its main chain, the yellowing of the cover 3 is suppressed. Examples of alicyclic diisocyanate include 4,4'-dicyclohexylmethane diisocyanate (H12MDI), 1,3-bis(isocyanatomethyl)cyclohexane (H6XDI), isophorone diisocyanate (IPDI), and trans-1,4-cyclohexane diisocyanate (CHDI). From the viewpoint of versatility and processability, H12MDI is preferable.

The resin composition of the cover 3 may include another polymer instead of polyurethane. Other examples of polymers include an ionomer resin, polystyrene, polyamide, polyester, and polyolefin. The resin composition may include two or more types of polymers.

The resin composition of the cover 3 may include a coloring agent such as titanium dioxide, a filler such as barium sulfate, a dispersant, an antioxidant, an ultraviolet absorber, a photostabilizer, a fluorescent agent, a fluorescent brightener, and the like.

The thickness of the cover 3 is preferably 0.2 mm or more, and particularly preferably 0.3 mm or more. The thickness of the cover 3 is preferably 2.5 mm or less, and particularly preferably 2.2 mm or less. The specific gravity of the cover 3 is preferably 0.90 or more, and particularly preferably 0.95 or more. The specific gravity of the cover 3 is preferably 1.10 or less, and particularly preferably 1.05 or less. It should be noted that the cover 3 may have two or more layers.

Figure 2:
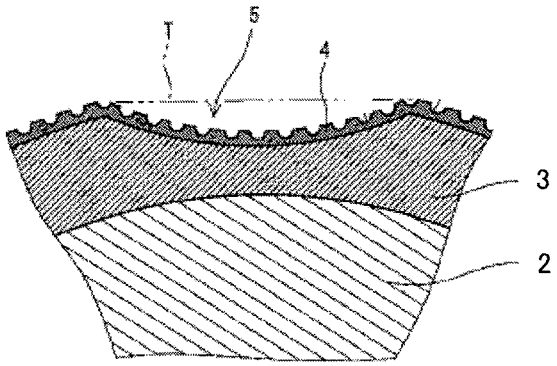
FIG. 2 is a partially enlarged cross-sectional view of FIG. 1.

Dimples 5 are formed on the surface of the cover 3. In FIG. 2, a virtual line T indicates a common tangent of two ends of the dimple 5. The volume of a portion enclosed by the virtual line T and the surface of the dimple 5 is the volume of the dimple 5. The total volume of the dimples 5 is preferably 270 $mm^3$ or more and 370 $mm^3$ or less. If the total volume is less than the above-described range, the trajectory of the golf ball sometimes rises. From this viewpoint, the total volume is more preferably 290 $mm^3$ or more. If the total volume is more than the above-described range, there is a risk that the trajectory of the golf ball drops. From this viewpoint, the total volume is more preferably 350 $mm^3$ or less.

The ratio of the total area of the dimples 5 to the surface area of a virtual sphere is referred to as "surface area occupation ratio". The surface area occupation ratio is preferably 70% or more and 90% or less. If the surface area occupation ratio is less than the above-described range, there is a risk that lift of the golf ball during flight becomes insufficient. From this viewpoint, the surface area occupation ratio is more preferably 72% or more, and particularly preferably 75% or more. On the other hand, if the surface area occupation ratio is more than the above-described range, the trajectory of the golf ball sometimes rises. From this viewpoint, the surface area occupation ratio is preferably 88% or less, and more preferably 86% or less. It should be noted that the area of the dimple 5 is the area of a region surrounded by an edge line (that is, the area of a planar shape) when the center of the golf ball is viewed from infinity.

The depth of each dimple 5 is preferably 0.1 mm or more and 0.6 mm or less. If the depth is less than the above-described range, the trajectory of the golf ball sometimes rises. From this viewpoint, the depth is more preferably 0.12 mm or more, and particularly preferably 0.14 mm or more. On the other hand, if the depth is more than the above-described range, the trajectory of the golf ball sometimes drops. From this viewpoint, the depth is more preferably 0.55 mm or less, and particularly preferably 0.50 mm or less. The ratio of the number of the dimples 5 whose depth is included in the above-described range to the total number of the dimples 5 is preferably 50% or more, more preferably 65% or more, and particularly preferably 80% or more. The depth is the distance from the virtual line T to the deepest portion of the dimple 5.

The total number of the dimples 5 is preferably 200 or more and 500 or less. If the total number is less than the above-described range, it is difficult to obtain the effects of the dimples. From this viewpoint, the total number is more preferably 230 or more, and particularly preferably 260 or more. On the other hand, if the total number is more than the above-described range, it is difficult to obtain the effects of the dimples. From this viewpoint, the total number is more preferably 470 or less, and particularly preferably 440 or less.

It should be noted that a single type of or a plurality of types of the dimples 5 may be formed. Noncircular dimples (dimples whose planar shape is noncircular) may be formed instead of or together with the circular dimples 5.

1-4. Coating Layer

Next, the coating layer 4 will be described. The coating layer 4 is configured by covering the surface of the cover 3 with paint. For example, a clear paint containing two-part curable polyurethane as a base material can be used as such paint, but there is no particular limitation as long as paint is used.

The thickness of the coating layer 4 is preferably 5.0 μm or more, more preferably 5.5 μm or more, and particularly preferably 6.0 μm or more. This is because if the thickness of the coating layer 4 is less than 5.0 μm, there is a risk that the coating layer 4 comes off the cover 3 in a step of forming roughness, which will be described later. On the other hand, there is no particular limitation on the upper limit of the thickness of the coating layer 4, but if the thickness of the coating layer 4 is increased by increasing the amount of paint applied, for example, there is a high possibility that the thickness of the coating layer 4 of the entire ball does not become uniform. From this viewpoint, the thickness of the coating layer 4 is preferably 30 μm or less.

Furthermore, roughness is formed on the surface of the coating layer 4. That is, as described later, after the smooth coating layer 4 is formed on the cover 3, roughness is formed on the surface of the coating layer 4. There are various methods for defining roughness. The inventors of the present invention used a maximum height Rz and an arithmetic average roughness Ra, and thus found that the desired aerodynamic effect could be obtained when the relationship between the Rz and the Ra satisfied the following expression.

$$Rz \geq Ra \times 6.0 \qquad \text{Exp. 1}$$

In particular, it was found that when the relationship between the maximum height Rz and the arithmetic average roughness Ra satisfied Expression 1, lift acting on the golf ball was suppressed, and as a result, the height of the trajectory was suppressed when hitting the golf ball, thus extending the flight-distance.

In this embodiment, the arithmetic average roughness Ra of the coating layer 4 is preferably 0.5 μm or more, more preferably 0.6 μm or more, and particularly preferably 0.7 μm or more. This is because if the arithmetic average roughness Ra is less than 0.5 μm, a sufficient aerodynamic effect due to roughness cannot be obtained. On the other hand, there is no particular limitation on the upper limit of the arithmetic average roughness Ra, but if roughness is increased, there is a possibility that intimate contact failure of the coating layer 4 with the cover 3 occurs or the coating layer 4 comes off the cover 3, and therefore the arithmetic average roughness Ra is preferably 5 μm or less.

On the other hand, the maximum height Rz is preferably 4.0 μm or more, more preferably 4.5 μm or more, and particularly preferably 5.0 μm or more. This is because if the maximum height Rz is less than 4.0 μm, a sufficient aerodynamic effect due to roughness cannot be obtained. On the other hand, there is no particular limitation on the upper limit of the maximum height Rz, but if roughness is increased, there is a possibility that intimate contact failure of the coating layer 4 with the cover 3 occurs or the coating layer 4 comes off the cover 3, and therefore the maximum height Rz is preferably 20 μm or less. It should be noted that the maximum height Rz and the arithmetic average roughness Ra are measured in accordance with JIS B0601 (2001).

2. Method for Producing Golf Ball

The golf ball is produced as follows. Known methods are used as a method for producing such a golf ball as appropriate. First, the core 1 is molded, and the intermediate layer 2 and the cover 3 are molded around the core 1 in this order. The dimples 5 are formed simultaneously with the molding of the cover 3. That is, a cavity of a metal mold for molding the cover is provided with a large number of raised portions for molding the dimples. Next, paint is applied to the surface of the cover 3. The coating layer 4 can be obtained by drying this paint. There is no particular limitation on the painting method when using curable paint, and known methods can be used. Examples thereof include spray painting and electrostatic painting.

When spray painting using an air gun is performed, a mixture obtained by supplying a polyol component and a polyisocyanate component using respective pumps and by continuously mixing them using a line mixer disposed just in front of the air gun may be applied by spraying, or polyol and polyisocyanate may be separately applied by spraying using an air spray system including a mixing ratio control mechanism. Coating may be achieved at one time by a spray application or may be repeated multiple times.

The curable paint that has been applied to the golf ball body can form a coating by being dried at a temperature of 30 to 70° C. for 1 to 24 hours, for example.

3. Method for Forming Roughness of Coating Layer

Next, a method for forming roughness of the coating layer 4 will be described. There are various methods for forming roughness of the coating layer 4, such as the following two methods.

3-1. Surface Treatment by Spraying Minute Particles

In this method, roughness is formed by spraying minute particles onto the surface of the coating layer 4. It is possible to spray minute particles with an air gun or the like onto the entire surface while rotating the ball, for example. It is desirable that the spraying pressure at this time is 1 to 10 bar. This is because a spraying pressure that is less than 1 bar makes it difficult to obtain the desired roughness, whereas a spraying pressure that is more than 10 bar causes a risk that not only the coating layer 4 but also the cover 3 are damaged.

Various types of minute particles can be used as the minute particles used in this method. Examples thereof include a natural ore, synthetic resin, and ceramic-based particles. For example, SiC, $SiO_2$, $AL_2O_3$, MgO, and $Na_2O$, or a mixture thereof can be used as a natural ore, and a thermoplastic resin and thermosetting resin that contain melamine-based resin as a main component, or a mixture thereof can be used as a synthetic resin. Moreover, one example of the ceramic-based particles is metal oxide such as zirconia. However, it is preferable to use minute particles having an average particle diameter of 50 μm or more in order to obtain the desired roughness. There is no particular limitation on the upper limit of the average particle diameter of minute particles, but if the particle diameter is increased, there is a possibility that it becomes difficult to spray the particles, and therefore, the average particle diameter is preferably 500 μm or less.

It should be noted that if the thickness of the coating layer 4 is too small when roughness is formed by this method, there is a risk that the coating layer 4 comes off during the spraying of minute particles. From this viewpoint, the thickness of the coating layer 4 is as described above.

3-2. Pressing Treatment

In this method, the desired roughness is formed by performing pressing treatment using a metal mold in which roughness has been formed on the inner wall surface of the cavity after the coating layer 4 is formed. Accordingly, the desired roughness is formed on the inner wall surface of the cavity in advance. There is no particular limitation on the metal mold used in this method as long as roughness is formed, and, for example, the same metal mold used to mold the dimples can be used. Roughness can be formed in advance on the inner wall surface of the cavity by spraying minute particles as described above.

It should be noted that if the thickness of the coating layer 4 is too small when roughness is formed by this method, it is difficult to form the desired roughness. From this viewpoint, the thickness of the coating layer 4 is as described above.

Although an embodiment of the present invention has been described above, the present invention is not limited to the above embodiment, and various modifications can be carried out without departing from the spirit of the invention. For example, as described above, there is no particular limitation on the number of layers of the core 1, the intermediate layer 2, and the cover 3, and it is sufficient to cover at least the surface of the member at the outermost layer with the coating layer. It should be noted that the above-described embodiment is configured by three layers that are the core 1, the intermediate layer 2, and the cover 3, and the intermediate layer and the cover correspond to a cover member of the present invention. Moreover, a two-piece structure including the core and the cover can be also achieved.

EXAMPLES

Hereinafter, examples of the present invention will be described. However, the present invention is not limited to the following examples.

Here, twelve types of golf balls in total including Working Examples 1 to 8 and Comparative Examples 1 to 4 were examined. These golf balls have the same basic specifications, but differ from each other in surface roughness. Furthermore, as described later, only Comparative Example 4 is different in the thickness of the coating layer. Accordingly, first, the common specifications will be described.

Common Specifications

A rubber composition was obtained by kneading 100 parts by mass of high-cis polybutadiene (product name "BR-730" manufactured by JSR Corporation), 35 parts by mass of zinc acrylate, 5 parts by mass of zinc oxide, 5 parts by mass of barium sulfate, 0.5 parts by mass of diphenyl disulfide, 0.9 parts by mass of dicumyl peroxide and 2.0 parts by mass of zinc octanoate. This rubber composition was placed into a metal mold configured by an upper mold and a lower mold, both of which have a semispherical cavity, and was heated at 170° C. for 18 minutes, and thus a core having a diameter of 39.7 mm was obtained.

A resin composition was obtained by kneading 50 parts by mass of an ionomer resin (product name "Surlyn 8945" manufactured by Du Pont), 50 parts by mass of another ionomer resin (product name "Himilan AM7329" manufactured by Du Pont-Mitsui Polychemicals), 4 parts by mass of titanium dioxide, and 0.04 parts by mass of ultramarine blue using a twin-screw kneading extruder. An intermediate layer was formed by covering the core with this resin composition by an injection molding method. The thickness of this intermediate layer was 1.0 mm.

A paint composition (product name "Polin 750LE" manufactured by Shinto Paint Co., Ltd.) containing a two-part curable epoxy resin as a base polymer was prepared. The main agent liquid for the paint composition is constituted by 30 parts by mass of a bisphenol A-type solid epoxy resin and 70 parts by mass of a solvent. The curing agent liquid for the paint composition is constituted by 40 parts by mass of modified polyamide amine, 55 parts by mass of a solvent, and 5 parts by mass of titanium oxide. The mass ratio of the main agent liquid and the curing agent liquid is 1/1. The paint composition was applied to the surface of the intermediate layer using a spray gun, and was allowed to stand under the atmosphere at 23° C. for 6 hours, and thus a reinforcing layer was obtained. The thickness of this reinforcing layer was 10 μm.

A resin composition was obtained by kneading 100 parts by mass of a thermoplastic polyurethane elastomer (product name "Elastollan XNY85A" manufactured by BASF Japan Ltd.) and 4 parts by mass of titanium dioxide using a twin-screw extruder. Half shells were made of this resin composition by a compression molding method. A sphere configured by the core, the intermediate layer, and the reinforcing layer was covered with the two half shells. The half shells and the sphere were placed into a final metal mold configured by an upper mold and a lower mold, both of which have a semispherical cavity and have a large number of pimples on the surface of the cavity, and then a cover was formed by a compression molding method. The thickness of the cover was 0.5 mm. The cover was provided with dimples having an inverted shape of the pimple. A coating layer was formed by applying a clear paint containing two-part curable polyurethane as a base material around the cover.

Specifically, the golf ball body was mounted on a rotator, and then the clear paint was applied while rotating the rotator at 300 rpm and vertically moving an air gun that was separated from the golf ball body by a spraying distance (7 cm). Each interval between the repeated applications was set to 1.0 second. The paint was applied using an air gun under the spraying condition in which the spraying air pressure was 0.15 MPa, the force feeding tank air pressure was 0.10 MPa, the single application time was 1 second, the atmospheric temperature was 20 to 27° C., and the atmospheric humidity was 65% or less.

The thickness of the coating layer will be described later. As a result, golf balls having a diameter of about 42.7 mm and a mass of about 45.6 g were obtained. The compressive deformation amount measured by a YAMADA compression tester when setting the load to 98 to 1274 N was about 2.45 mm. Table 1 shows the specifications of the dimples of the golf ball.

TABLE 1

| Type | Number | Diameter Dm (mm) | Depth Dp (mm) | Curvature CR (mm) | Spherical surface area s ($mm^2$) | Volume ($mm^3$) |
|---|---|---|---|---|---|---|
| A | 16 | 4.600 | 0.259 | 19.66 | 16.67 | 2.157 |
| B | 30 | 4.500 | 0.254 | 18.82 | 15.95 | 2.021 |
| C | 30 | 4.400 | 0.249 | 17.99 | 15.25 | 1.892 |
| D | 150 | 4.300 | 0.244 | 17.19 | 14.56 | 1.770 |
| E | 30 | 4.200 | 0.239 | 16.40 | 13.89 | 1.654 |
| F | 66 | 4.100 | 0.234 | 15.63 | 13.23 | 1.544 |

TABLE 1-continued

| Type | Number | Diameter Dm (mm) | Depth Dp (mm) | Curvature CR (mm) | Spherical surface area s ($mm^2$) | Volume ($mm^3$) |
|---|---|---|---|---|---|---|
| G | 10 | 3.800 | 0.220 | 13.44 | 11.36 | 1.247 |
| H | 12 | 3.400 | 0.203 | 10.77 | 9.09 | 0.922 |

Working Examples

In Working Examples 1 to 7, roughness was formed on the surface of the coating layer of the golf ball obtained as described above by the following method. That is, after the coating layer was formed, minute particles were sprayed thereon using an air gun having a nozzle diameter of 8 mm. At this time, 20 balls of each working example were placed into a predetermined treatment device, and minute particles were sprayed thereon with a predetermined pressure for 1 minute while rotating the device. The pressure at this time and minute particles used are as shown in Table 2.

In Working Example 8, roughness was formed on the coating layer using a metal mold in which roughness was formed on the inner wall surface of the cavity. The metal mold used at this time was the same metal mold that had been used to form the dimples. Natural ore particles having a particle diameter of 400 to 600 μm were sprayed onto the cavity of this metal mold with a pressure of 5 bar. The spraying time was about 30 seconds, and the natural ore particles were evenly sprayed onto the cavity.

In Working Examples 1 to 8, the thickness of the coating layer was 18 μm. The paint was applied twice.

Comparative Examples

In Comparative Example 1, after the coating layer was formed, surface treatment was not performed on its surface.

In Comparative Examples 2 and 3, as in the above-described Working Examples 1 to 7, after the coating layer was formed, roughness was formed by spraying minute particles. The pressure at this time and minute particles used are as shown in Table 2. It should be noted that in Comparative Examples 1 to 3, the thickness of the coating layer was 18 μm, and in Comparative Example 4, the paint was applied only once and the thickness thereof was set to 4 μm.

The maximum height Rz, the arithmetic average roughness Ra, and the like in the working examples and comparative examples, which were formed as described above, are as shown in Table 2.

TABLE 2

| | Work. Ex. 1 | Work. Ex. 2 | Work. Ex. 3 | Work. Ex. 4 | Work. Ex. 5 | Work. Ex. 6 | Work. Ex. 7 | Work. Ex. 8 | Comp. Ex. 1 | Comp. Ex. 2 | Comp. Ex. 3 | Comp. Ex. 4 |
|---|---|---|---|---|---|---|---|---|---|---|---|---|
| Type of minute particle | Synthetic resin | Natural ore | Ceramic-based particle | Natural ore | Natural ore | Natural ore | Natural ore | | | Natural ore | Natural ore | Natural ore |
| Diameter of minute particle (μm) | 150-250 | 75-150 | 75-150 | 75-150 | 75-150 | 75-150 | 250-500 | | | 30-50 | 30-50 | 75-150 |
| Spraying pressure (bar) | 5.5 | 1.5 | 1.5 | 3.5 | 5.5 | 7.5 | 5.5 | | | 1.5 | 3.5 | 5.5 |
| Ra (μm) | 0.40 | 0.57 | 0.75 | 0.77 | 0.93 | 1.04 | 1.51 | 0.54 | 0.36 | 0.48 | 0.84 | 0.91 |
| Rz (μm) | 3.85 | 4.92 | 5.40 | 6.52 | 6.90 | 7.70 | 10.10 | 5.94 | 1.12 | 2.50 | 4.38 | 6.70 |
| Thickness of coating layer (μm) | 18 | 18 | 18 | 18 | 18 | 18 | 18 | 18 | 18 | 18 | 18 | 4 |

Figure 3:
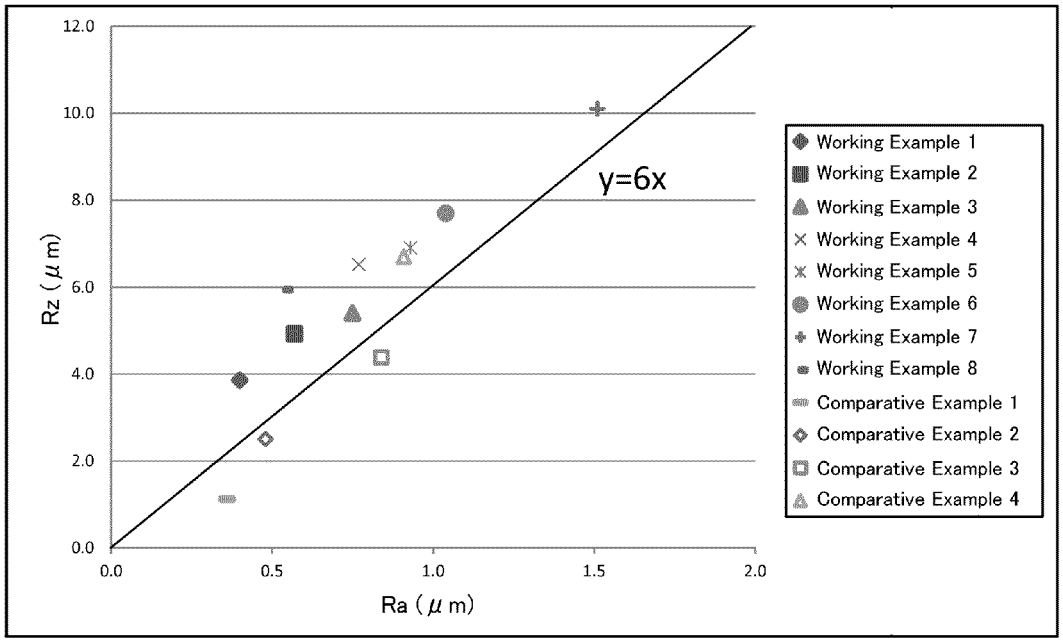
FIG. 3 is a graph illustrating relationships between Rz and Ra in working examples and comparative examples.

The maximum height Rz and the arithmetic average roughness Ra were measured using a surface roughness measuring instrument (Surfcom 130A manufactured by Tokyo Seimitsu Co., Ltd.). Six balls of each of the working examples and comparative examples were prepared, roughness was measured at six points in a dimple of each ball, and the average values were used as the Rz and the Ra. Moreover, as shown in a graph of FIG. 3, in Working Examples 1 to 8, the relationship between the measured Ra and Rz satisfied above-described Expression 1, and in Comparative Examples 1 to 4, the relationship therebetween did not satisfy Expression 1.

Evaluation Test

A flight-distance test and a striking test were performed on the working examples and comparative examples formed as described above.

Flight-Distance Test

An iron club (product name "SRIXON 2525" manufactured by Dunlop Sports Co., Ltd.; a five iron, shaft hardness: S, loft angle: 24°) was attached to a swing machine manufactured by Golf Laboratories Inc. Then, 20 balls of each type of the golf balls were hit, the distance (carry) to the point where the ball fell was measured, and the average was calculated. The balls were hit under the condition in which the head speed was 41 m/sec, the launch angle was about 14°, and the backspin speed was about 4700 rpm. The test was performed in a state where substantially no wind blew. Table 3 shows the results.

Striking Test

The balls of the working examples and comparative examples were struck 50 times by a hammering test machine, and then the state of the surface was checked. Table 3 shows the results. The balls in which the coating layer did not come off were evaluated as "Good", and the balls in which the coating layer came off were evaluated as "Poor".

TABLE 3

| | Work. Ex. 1 | Work. Ex. 2 | Work. Ex. 3 | Work. Ex. 4 | Work. Ex. 5 | Work. Ex. 6 | Work. Ex. 7 | Work. Ex. 8 | Comp. Ex. 1 | Comp. Ex. 2 | Comp. Ex. 3 | Comp. Ex. 4 |
|---|---|---|---|---|---|---|---|---|---|---|---|---|
| Carry (m) | 175.7 | 176.2 | 175.9 | 176.4 | 176.6 | 176.9 | 176.7 | 176.3 | 175.0 | 175.1 | 175.2 | 176.5 |
| Trajectory height (m) | 30.5 | 30.5 | 30.3 | 30.4 | 30.3 | 30.1 | 29.8 | 30.4 | 31.0 | 30.9 | 30.8 | 30.4 |
| State after multiple strikes | Good | Good | Good | Good | Good | Good | Good | Good | Good | Good | Good | Poor |

Evaluation

As shown in Table 3, in the flight-distance test, the trajectories of the working examples were generally lower than those of the comparative examples. That is, it is thought that lift was reduced due to setting roughness of the coating films of the working examples so as to satisfy Expression 1. As a result, the flight-distances of all of the working examples were extended compared with those of the comparative examples. On the other hand, in the striking test, in Comparative Example 4 having a coating layer with a small thickness, the coating film noticeably came off, and the appearance was poor.

The invention claimed is:

1. A golf ball comprising:

a spherical core;

at least one cover member that covers the core; and a coating layer that covers the cover member configuring an outermost layer, wherein a plurality of dimples are formed in the cover member configuring the outermost layer, the thickness of the coating layer is 5.0 μm or more, roughness is formed on a surface of the coating layer after coating the cover member configuring the outermost layer, and a maximum height Rz and an arithmetic average roughness Ra of the surface of the coating layer satisfy a relationship $Rz \geq Ra \times 6.0$.

2. The golf ball according to claim 1, wherein the arithmetic average roughness Ra is 0.5 μm or more.

3. The golf ball according to claim 1, wherein the maximum height Rz is 4.0 μm or more.

4. The golf ball according to claim 1, wherein the roughness of the coating layer is formed by spraying particles.

5. The golf ball according to claim 4, wherein an average particle diameter of the particles is 50 μm or more.

6. The golf ball according to claim 1, wherein the roughness of the coating layer is formed by a metal mold in which roughness is formed on an inner wall surface of a cavity being pressed onto the coating layer obtained by coating the cover member.

7. A method for producing a golf ball comprising:

a step of forming a spherical core;

a step of covering the spherical core with at least one cover member and forming a plurality of dimples in the cover member configuring an outermost layer;

a step of covering the cover member configuring the outermost layer with a coating layer; and a step of forming roughness on the coating layer, wherein a maximum height Rz and an arithmetic average roughness Ra of the surface of the coating layer satisfy a relationship $Rz \geq Ra \times 6.0$.

8. The method for producing golf ball according to claim 7, wherein the arithmetic average roughness Ra is 0.5 μm or more.

9. The method for producing golf ball according to claim 7, wherein the maximum height Rz is 4.0 μm or more.

10. The method for producing golf ball according to claim 7, wherein the roughness of the coating layer is formed by spraying particles.

11. The method for producing golf ball according to claim 10, wherein an average particle diameter of the particles is 50 μm or more.

12. The method for producing golf ball according to claim 7, wherein the roughness of the coating layer is formed by a metal mold in which roughness is formed on an inner wall surface of a cavity being pressed onto the coating layer obtained by coating the cover member.

* * * * *